US011292286B2

(12) United States Patent
Brechling et al.

(10) Patent No.: US 11,292,286 B2
(45) Date of Patent: Apr. 5, 2022

(54) TRANSPORT DEVICE FOR TRANSPORTING COIN BLANKS AND METHOD FOR PRODUCING A COIN

(71) Applicant: SCHULER PRESSEN GMBH, Goeppingen (DE)

(72) Inventors: Carsten Brechling, Ulm (DE); Wolfgang Hoyler, Donzdorf (DE); Simon Kneer, Eislingen (DE); Horst Jaeschke, Birenbach (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 342 days.

(21) Appl. No.: 15/920,892

(22) Filed: Mar. 14, 2018

(65) Prior Publication Data

US 2018/0201052 A1 Jul. 19, 2018

Related U.S. Application Data

(63) Continuation-in-part of application No. PCT/EP2016/070527, filed on Aug. 31, 2016.

(30) Foreign Application Priority Data

Sep. 16, 2015 (DE) ..... 10 2015 115 647.4

(51) Int. Cl.
*B44B 5/02* (2006.01)
*B44B 5/00* (2006.01)
(Continued)

(52) U.S. Cl.
CPC ..... *B44B 5/024* (2013.01); *B21D 22/02* (2013.01); *B21D 43/003* (2013.01); *B44B 5/0052* (2013.01)

(58) Field of Classification Search
CPC .... B21D 22/02; B21D 43/003; B21D 39/031; B21D 39/032; B21D 28/12; B21D 28/125;
(Continued)

(56) References Cited

U.S. PATENT DOCUMENTS 4,167,344 A 9/1979 High et al.
4,549,419 A * 10/1985 Trost ..... B21J 13/08 198/394
(Continued)

FOREIGN PATENT DOCUMENTS

CN 1586760 A 2/2005
DE 37 42 745 A1 7/1989
(Continued)

OTHER PUBLICATIONS

Machine Translation of EP-0511551-A1, Karl, Publication Year 1992, Total Pages 3. (Year: 2020).*
(Continued)

*Primary Examiner* — Teresa M Ekiert
*Assistant Examiner* — Sarkis A Aktavoukian
(74) *Attorney, Agent, or Firm* — Ronald S. Lombard

(57) ABSTRACT

A transport device and a method for producing a coin with use of the transport device. The transport device is used to transport blanks to a minting station. A drivable first transport part having a plurality of first transport pockets is provided. A first clearance exists between the outer contour of the blank and the inner contour of the first transport pocket. The transport device has a second transport part having a plurality of second transport pockets. A second clearance is provided between the outer contour of the blank and the inner contour of the second transport pocket. The second clearance is larger than the first clearance. The blanks are transferred at a transfer location from a particular first
(Continued)

transport pocket into a second transport pocket. The blanks are transported in the second transport pocket to the minting station, and a coin is minted there from the blank.

13 Claims, 6 Drawing Sheets

(51) Int. Cl.
*B21D 22/02* (2006.01)
*B21D 43/00* (2006.01)

(58) Field of Classification Search
CPC ..... B21D 28/35; B65G 37/005; B65G 29/00; B44B 5/024; B44B 5/0052; B44B 5/02; B41F 19/02; B41F 19/06
USPC ..... 198/473.1, 608; 101/4, 31.1, 32
See application file for complete search history.

(56) References Cited

U.S. PATENT DOCUMENTS

| | | | | | |
|---|---|---|---|---|---|
| 4,613,397 | A * | 9/1986 | Buchholz | B65C 3/22 156/476 |
| 5,220,614 | A * | 6/1993 | Crain | G06K 9/00 348/128 |
| 2009/0090157 | A1* | 4/2009 | Schlatter | B21D 28/26 72/336 |

FOREIGN PATENT DOCUMENTS

| | | | | | |
|---|---|---|---|---|---|
| DE | 19841622 | A1 | | 3/2000 | |
| DE | 100 57 000 | A1 | | 5/2001 | |
| DE | 10 2013 106 375 | A1 | | 12/2014 | |
| DE | 102013106375 | A1 | | 12/2014 | |
| EP | 0320731 | A2 | * | 6/1989 | B44B 5/024 |
| EP | 0511551 | A1 | * | 11/1992 | B21D 43/14 |
| EP | 0320731 | B1 | | 6/1993 | |
| GB | 2171829 | A | | 10/1986 | |
| GB | 2311952 | A | * | 10/1997 | |
| GB | 2493059 | A | * | 1/2013 | |
| GB | 2493059 | A | | 1/2013 | |
| JP | 2001205372 | A | | 7/2001 | |

OTHER PUBLICATIONS

Machine Translation of DE-10057000-A1, Kazuo et al., Publication Year 2001, Total Pages 25. (Year: 2020).*

English translation of International Search Report for corresponding international application PCT/EP2016/070527, 2 pages, dated Nov. 3, 2016.

English translation of Office Action and Search Report of the Chinese Patent Office dated Dec. 21, 2018, for corresponding Chinese patent application No. 201680053594.X; Office Action and Search Report attached of in the Chinese language.

* cited by examiner

TRANSPORT DEVICE FOR TRANSPORTING COIN BLANKS AND METHOD FOR PRODUCING A COIN

CROSS-REFERENCE TO RELATED APPLICATIONS

This is a continuation-in-part application of pending international application PCT/EP2016/070527 filed Aug. 31, 2016, and claiming the priority of German application No. 10 2015 115 647.4 filed Sep. 16, 2015. The said International application PCT/EP2016/070527 and German application No. 10 2015 115 647.4 are both incorporated herein by reference in their entireties as though fully set forth.

BACKGROUND OF THE INVENTION

The invention relates to a transport device for transporting coin blanks, which are referred to merely as blanks, and/or constituents thereof to a minting station. The invention also relates to a method for producing coins from blanks. In particular, the blanks are multi-part blanks having at least one ring and a disc-shaped core.

DE 3742745 A1 describes an automatic minting machine for ring-and-core coins. Here, rings are fed at a first location to a revolving plate. At another location, cores are inserted into the rings provided on the revolving plate. The blanks consisting of a ring and a core are then fed via the revolving plates to a minting station.

DE 10 2013 106375 A1 likewise describes a transport device for transporting blanks comprising a ring and a core to a minting station. At one location, the core is inserted into the hole of the ring by means of a press-in device and is then transported further to the minting station by means of the transport device.

The insertion of a blank core into the blank ring requires a precise orientation of the core relative to the ring in order to enable the core to be pressed in. In the event of blanks that are not round and that are processed prior to the minting, a precise positioning and/or orientation of the rotary position of the blank about its blank axis is likewise necessary, for example if a hole and in particular a hole that is not round is used.

The object of the invention can therefore be considered that of enabling an improved positioning and/or orientation of the blanks at a preparation station, prior to the minting, as the blanks are being transported to a minting station.

SUMMARY OF THE INVENTION

This object is achieved by a transport device for transporting coin blanks and a method for producing a coin with use of the transport device in accordance with the claims. The invention relates to a transport device 15 and a method for producing a coin with use of the transport device 15. The transport device 15 is used to transport blanks 16 to a minting station 17. To this end, a drivable first transport part 19 having a plurality of first transport pockets 20 is provided. A first clearance S1 exists between the outer contour 51 of the blank 16 and the inner contour 50 of the first transport pocket 20. The transport device 15 additionally has a second transport part 26 having a plurality of second transport pockets 27. A second clearance S2 is provided between the outer contour 51 of the blank 16 and the inner contour 52 of the second transport pocket 27. The second clearance S2 is larger than the first clearance S1. The blanks 16 are transferred at a transfer location 34 from a particular first transport pocket 20 into a second transport pocket 27. In the second transport pocket 27 the blanks 16 are transported to the minting station 17 and a coin is minted there from the blank 16. The minted coin is then transported further from the minting station 17 in the first transport pocket 27 of the first transport part 26 and is removed from the first transport part 26 at a removal location 40.

The transport device according to the invention comprises a drivable first transport part. The first transport part can preferably be formed by a first revolving plate. The first transport part has a plurality of first transport pockets, wherein precisely one blank can be transported in each of the first transport pockets. A first clearance is provided between the outer contour of the blank and the inner contour of the first transport pocket. As a result of this first clearance, the blank can move in a plane within the first transport pocket, i.e. in two dimensions.

The transport device additionally includes a second transport part, which preferably can be formed by a second revolving plate. The second transport part comprises a plurality of second transport pockets, wherein precisely one blank can be transported in each of the second transport pockets. A second clearance is provided between the outer contour of the blank and the inner contour of the second transport pocket. The second clearance is larger than the first clearance. The movement of the blank in a plane in a second transport pocket relative to the transport part is therefore greater than in a first transport pocket.

The first and/or second transport pockets can be partially or fully closed in the peripheral direction around the blank. They surround the blank in each case in such a way that the blank is held in the corresponding transport pocket during its transport. The transport pockets are preferably open on both sides at right angles to the blank in a height direction. As the transport part in question moves, the blanks slide along their movement path on a suitable substrate.

The movement path or transport path of the blanks in the first transport part and/or in the second transport part corresponds preferably to a circular path. The movement along a circular path of this kind can be well synchronised with the processing of the blanks, for example the minting of the blanks by a minting press at the minting station or the forming of a hole by means of a hole-forming device at a hole-forming station, or the insertion of a core into a ring of the blank by means of a joining device at a joining station.

At a transfer location, the blanks are transferred from the first transport part to the second transport part. The minting station, at which the blanks are minted in order to produce the coins, is associated with the second transport part. The second transport part is designed to transport the blanks from the transfer location to the minting station or the minting press and from the minting station. The second clearance of the second transport pockets is sufficiently great to receive the minted coins, the surface of which is enlarged compared to the blank. Since the first clearance between the blanks and the first transport pockets of the first transport part is smaller, the blanks are positioned in a more exact manner in the first transport pockets and can be processed easily and precisely, for example at a hole-forming station in order to form the hole in a blank disc, or a forming station for forming an inner edge of a blank ring, or a joining station for joining a core in the ring of a blank. The preparation of the blank prior to the minting is thus simplified. A high output of the minting of coins can also be achieved by means of the transport device.

Each blank preferably comprises a plurality of constituents, in particular at least one ring with a hole, and a core inserted into the hole. A blank can also consist of more than two constituents and for example can comprise an outer ring, an inner ring, and a core. The materials of the constituents can be different. A metal or a metal alloy or also plastic can be used for each constituent of the blank.

It is advantageous if there is a preparation station arranged adjacently to the first transport part, which preparation station is designed to prepare the blanks for a subsequent minting operation. The preparation station for example can be a joining station, which is designed to join together at least two constituents of the blank, for example a core and a ring or an outer ring and an inner ring. Additionally or alternatively a preparation station can also be a hole-forming station, in which a hole is formed in a blank disc so as to be able to insert there an inner ring or a core. A corresponding punching or cutting device or another suitable separating device can be provided at the hole-forming station in order to form a hole in the round blank. Additionally or alternatively a preparation station can also be a forming station for forming an inner edge of a blank ring, to which a blank ring is fed for forming and which for example can follow on from a hole-forming station.

It is additionally advantageous if a control device is provided. The control device can be used for example for coordination of the different stations and/or drives of the transport parts. The control device is designed in particular to control and in particular to synchronise a first drive for the first transport part and a second drive for the second transport part. In particular, the minting press at the minting station and/or a separating device at the hole-forming station and/or a joining device at the joining station and/or a forming device at a forming station are/is also controlled in a coordinated manner by means of the two drives.

In an advantageous embodiment the two drives are designed as stepper drives. They are rotated about respective axes of rotation by the control device step-by-step or intermittently, in each case by a predefined rotary angle.

Alternatively, it is also possible that the two drives for the transport parts have a common drive motor and in each case a transmission is provided between the drive motor and the relevant transport part in order to generate the desired movement. Here, the synchronised movement is achieved by a mechanical coupling.

The number of first transport pockets at the first transport part is preferably greater than the number of the second transport pockets at the second transport part. For example, the diameter of the first revolving plate can be larger than the diameter of the second revolving plate, so that a greater number of first transport pockets can be arranged at the first revolving plate. A plurality of preparation stations can also be arranged readily at the first transport part.

The method according to the invention for producing a coin is as follows:

Firstly, a blank is transported in a first transport pocket of the first transport part to the transfer location. At the transfer location, the blank is transferred to the second transport part and is received there in one of the second transport pockets. The blank is then moved in a second transport pocket of the second transport part to the minting station. At the minting station a coin is minted from the blank. The minted coin is moved from the minting station with the aid of the second transport part.

The blank is preferably prepared for the subsequent minting at least at one preparation station during the transport by means of the first transport part. For example, in this case an inner constituent, for example a core or an inner ring, can be inserted at a joining station into an outer constituent, for example an inner ring or an outer ring. In order to produce a ring, a hole-forming station can additionally be provided in order to produce a ring of the blank from a blank disc.

BRIEF DESCRIPTION OF THE DRAWINGS

Advantageous embodiments of the invention will become clear from the claims, the description, and the drawings. Preferred exemplary embodiments will be explained in detail hereinafter on the basis of the accompanying drawings, in which:

DETAILED DESCRIPTION OF THE INVENTION

Figure 1:
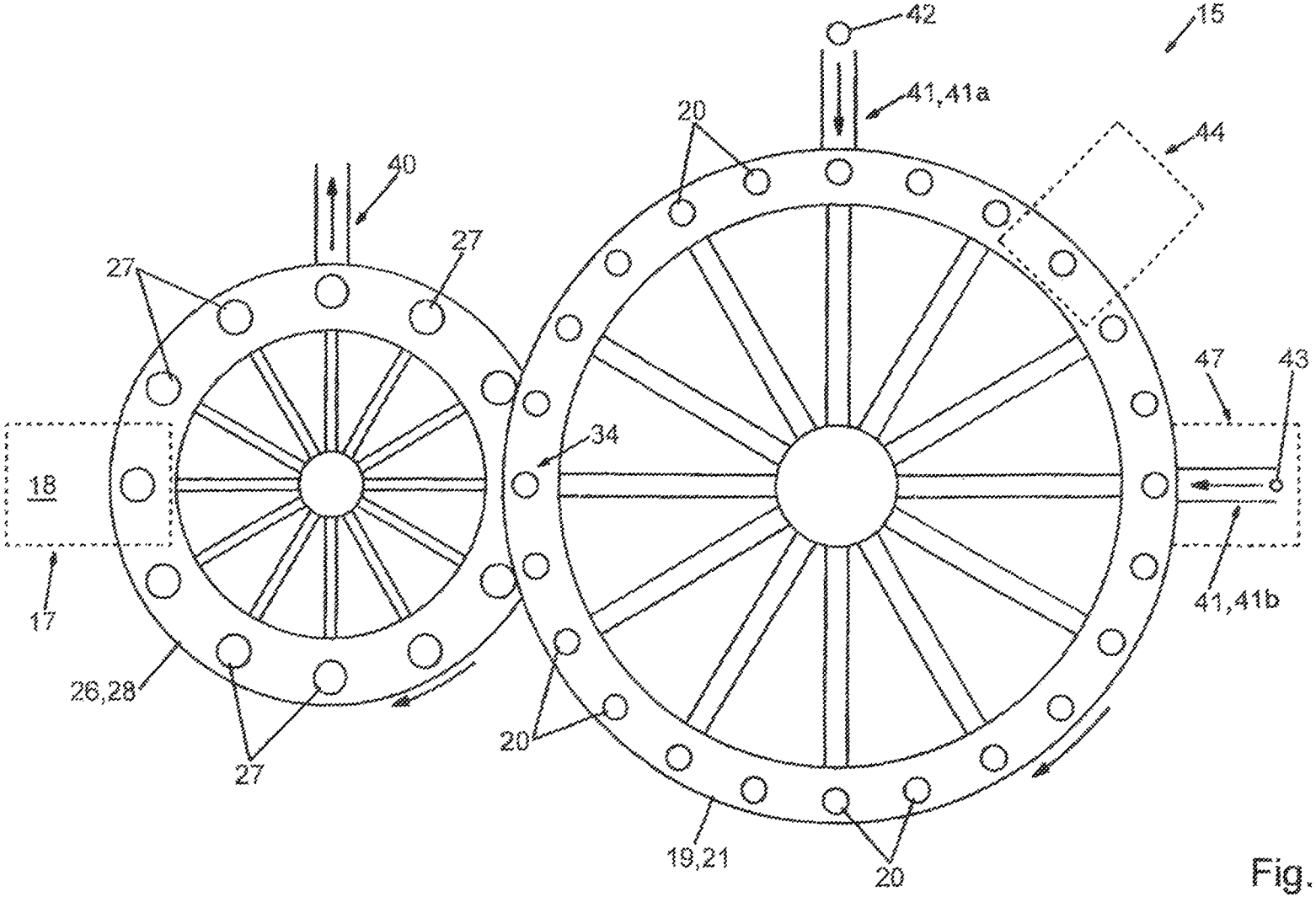
FIG. 1 shows a schematic block diagram-like depiction of an exemplary embodiment of a transport device in plan view.
Figure 2:
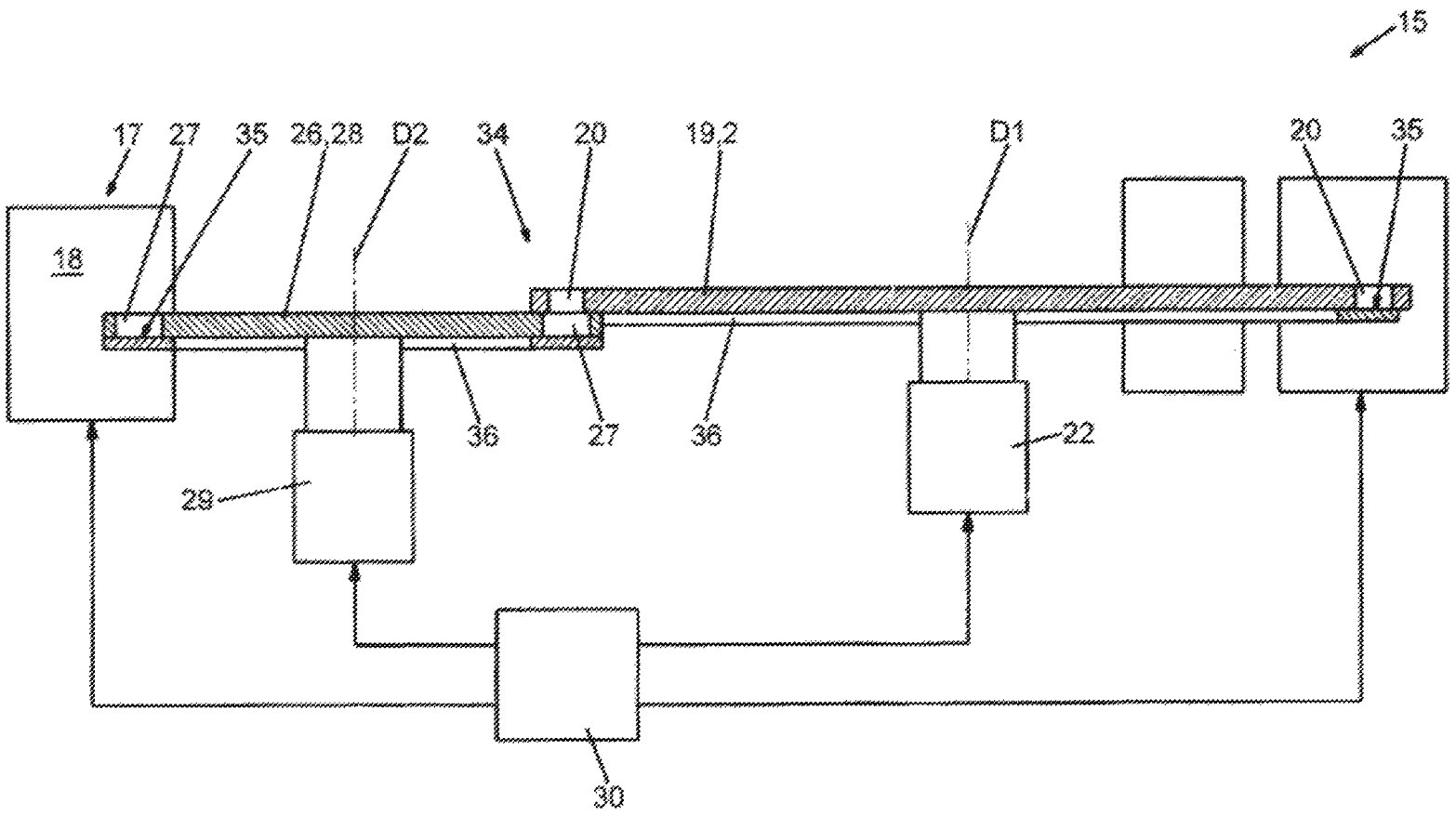
FIG. 2 shows the exemplary embodiment of the transport device from FIG. 1 in a schematic, block diagram-like, partially sectional depiction in a side view.
Figure 3:
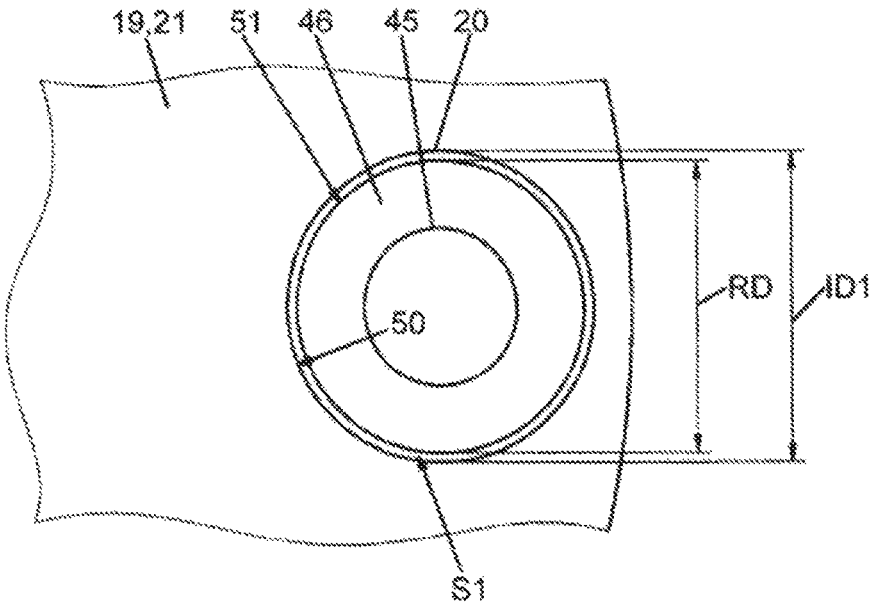
FIG. 3 shows an exemplary embodiment of a first transport pocket with a blank.
Figure 4:
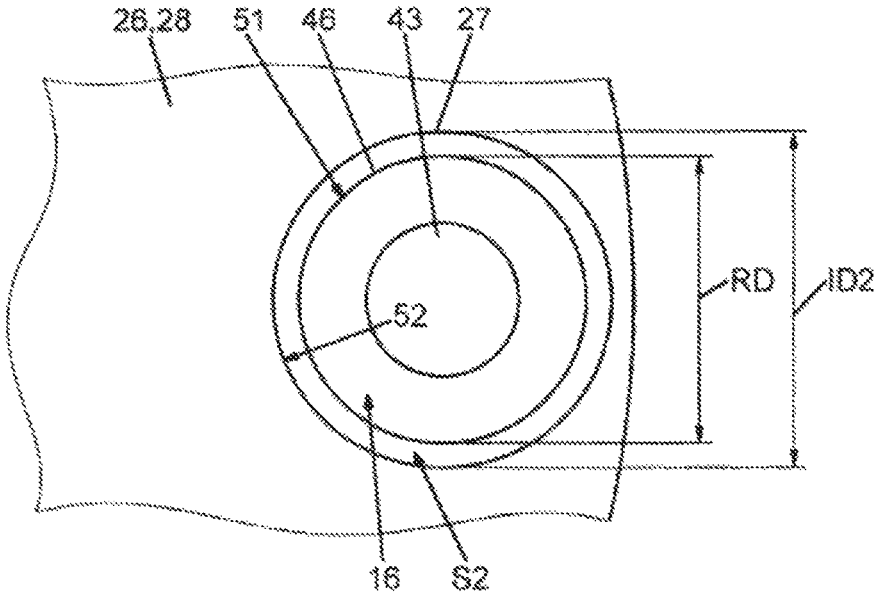
FIG. 4 shows an exemplary embodiment of a second transport pocket with a blank.
Figure 5:
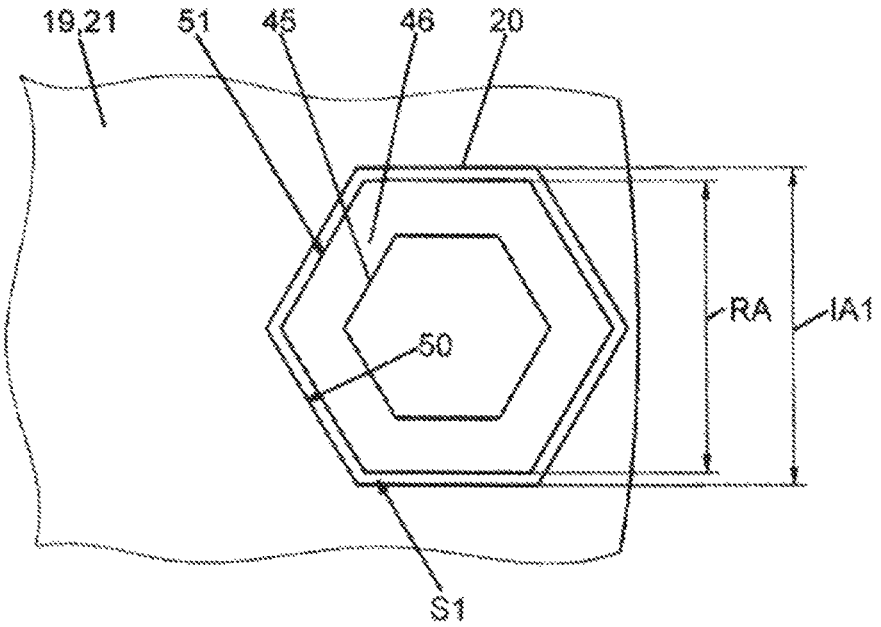
FIG. 5 shows a further exemplary embodiment of a first transport pocket with a blank.
Figure 6:
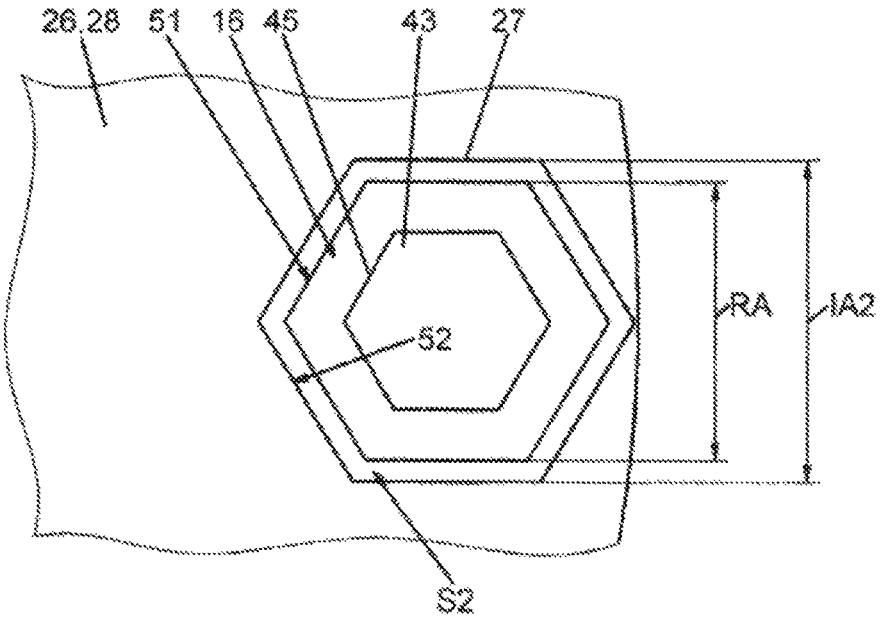
FIG. 6 shows a further exemplary embodiment of a second transport pocket with a blank.
Figure 7:
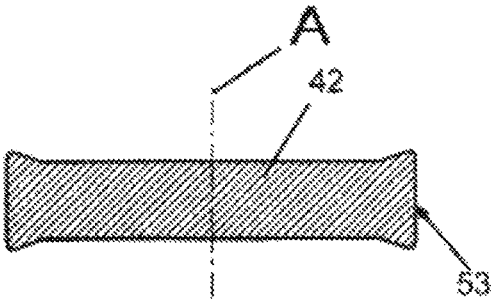
FIG. 7 shows an exemplary embodiment of a blank disc in cross-section.
Figure 8:
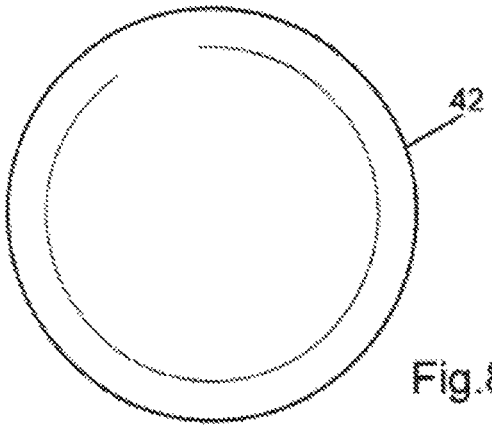
FIG. 8 shows the plan view of the embodiment of a blank disc according to FIG. 7.
Figure 13:
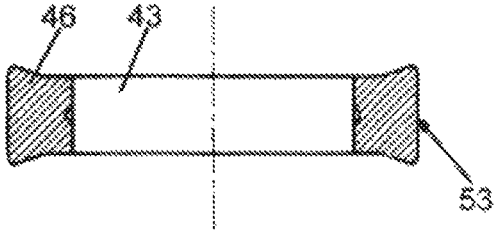
FIG. 13 shows an exemplary embodiment of a blank with ring and inserted core in cross-section.
Figure 14:
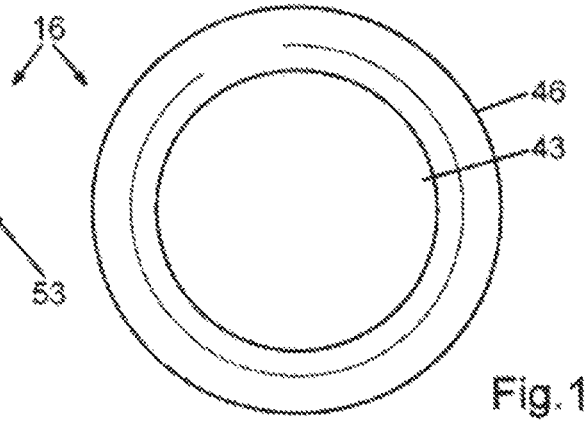
FIG. 14 shows the plan view of the embodiment of a blank with ring and inserted core according to FIG. 13.

In FIGS. 1 and 2 an exemplary embodiment of a transport device 15 for transporting blanks 16 (FIGS. 13 and 14) to a minting station 17 comprising a minting press 18 and from the minting station 17 is depicted schematically. The transport device 15 comprises a first transport part 19 having a plurality of first transport pockets 20. In accordance with the example the first transport part 19 is formed by a first revolving plate 21, which can be driven step-by-step by means of a first drive 22 about a first axis of rotation D1. The first transport pockets 20 are uniformly distributed in the peripheral direction about the first axis of rotation D1.

The transport device 15 additionally includes a second transport part 26 having a plurality of second transport pockets 27. The second transport part 26 is formed by a second revolving plate 28, which can be driven step-by-step about a second axis of rotation D2 by means of a second drive 29. The two axes of rotation D1, D2 are oriented parallel to one another. The second transport pockets 27 are arranged on the second revolving plate 28 in a manner uniformly distributed in the peripheral direction about the second axis of rotation D2. The number of second transport pockets 27 is smaller than the number of the first transport pockets 20. The diameter of the second revolving plate 28 is smaller than the diameter of the first revolving plate 21.

The circular path along which the first transport pockets 20 are arranged has a larger diameter than the circular path along which the second transport pockets are arranged. The first transport pockets 20 are smaller than the second transport pockets 27.

The two drives 22, 29 would be controlled and coordinated by means of a control device 30, such that the step-by-step movements of the two revolving plates 21, 28 are synchronised.

At a transfer location 34, the transport device 15 is designed to transfer the blanks 16 transported by means of the first revolving plate 28 to the second revolving plate 21. In the exemplary embodiment the transport of the blanks 16 at the transfer location 34 is performed or assisted by the force of gravity. Additionally, a transfer device controllable by the control device 30 can also be provided. For example, the two revolving plates 21, 28 can be arranged offset in different planes as considered parallel to the axes of rotation D1, D2 and overlap one another at the transfer location 34 in such a way that a blank 16 can be transported or can fall from a first transport pocket 20 into a second transport pocket 27. The movement optionally can be assisted or performed by a transfer device.

In contrast to that shown in the drawing, a transfer device controllable by the control device 30 can also be provided in order to transport the blank 16 from a first transport pocket 20 into a second transport pocket 27. This can also be performed against the force of gravity. The first revolving plate 21 can also be arranged at the transfer location 34 vertically beneath the second revolving plate 28. A ram or the like can be used as a transfer device at the transfer location 34, which ram raises the blank 16 from the first transport pocket 20 into the second transport pocket 27.

A support surface 35 for the blanks 16 and minted coins disposed in the transport pockets 20, 27 respectively is provided beneath each of the revolving plates 21, 28. The revolving plates 21, 28 rotate relative to the corresponding support surfaces 35, whereby the blanks or coins are moved in a sliding manner on the support surfaces 35. The support surfaces 35 are provided on appropriate sides of corresponding support parts 36 associated with the transport pockets 20, 27 and illustrated merely in a heavily schematic manner in FIG. 2.

The second transport part 26 or the second revolving plate 28 is used to transport the blanks 16 from the transfer location 34 to the minting station 17 and for the transport of finished, minted coins from the minting station 17 to a removal location 40. At the removal location 40, the finished, minted coins are removed from the second transport part 26.

The first transport part 19 or the first revolving plate 21 transports the blanks to the transfer location 34. Depending on the design of the blanks 16, one or more feed locations 41 for constituents of the blanks 16 is/are provided. In the exemplary embodiment two feed locations 41*a*, 41*b* are provided. A blank disc 42 is fed at one feed location 41*a*. A core 43 of the blank 16 is fed at a further feed location 41*b*. A hole-forming station 44 is provided between the two feed locations 41*a*, 41*b*, at which station a hole 45 (FIGS. 9 and 10) is formed in the blank disc 42 so as to produce a ring 46 from the blank disc 42. A joining station 47 is provided at the feed location 41*b* for the cores 43, following on from the hole-forming station 44. The cores 43 are inserted into the ring 46 of the blanks 16 at the joining station 47. The blanks 16 are transported from the joining station 47 with cores 43 inserted into the ring 46 (FIGS. 13 and 14) as far as the transfer location 34 by means of the first transport part 19 or the first revolving plate 21. The first transport part 19 consequently transports the multi-part blanks 16 and also individual constituents thereof (rings 46) in the first transport pockets 20.

Figure 9:
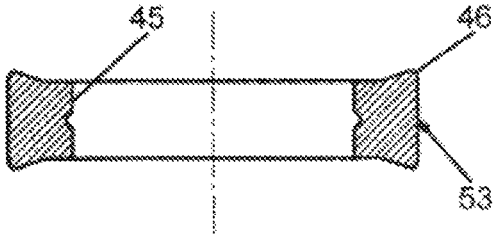
FIG. 9 shows an exemplary embodiment of a ring of a blank in cross-section.
Figure 10:
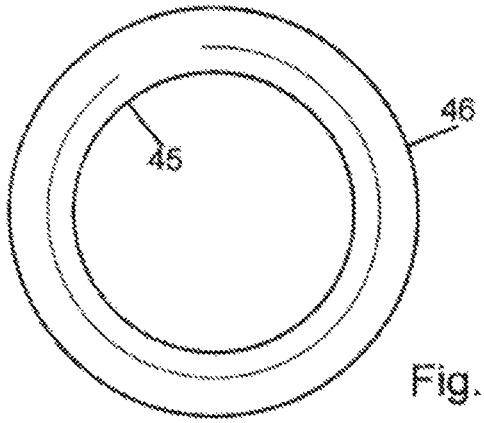
FIG. 10 shows the plan view of the embodiment of a ring of a blank according to FIG. 9.
Figure 11:
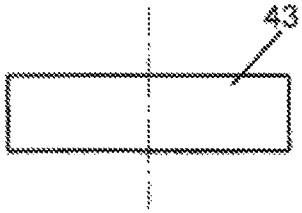
FIG. 11 shows an exemplary embodiment of a core of a blank in a side view.
Figure 12:
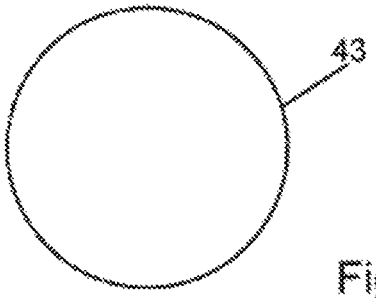
FIG. 12 shows the plan view of the embodiment of a core of a blank according to FIG. 11.

It can be seen schematically in FIGS. 9 and 10 that an annular concave indentation can be formed on the inner side of the ring 46 in the hole-forming station 44 (FIG. 1). This forming operation can also be performed in a separate forming station. As the blank 16 is minted, material of the core 43 is displaced and flows into this indentation, so that a positively engaged connection is established between the core 43 and the ring 46. Instead of an annular indentation that runs around in a circular manner, other types of indentations or recesses could also be provided on the inner side of the ring 46 in order to produce the positive engagement between the core 43 and the ring 46. As a result of this positive engagement, the forces necessary to push out the core 43 of a minted coin from the ring 46 are sufficiently large and meet the requirements of the minting facility.

Embodiments of a first transport pocket 20 (FIGS. 3 and 5) and of a second transport pocket 27 (FIGS. 4 and 6) are shown by way of example in FIGS. 3 to 6. The transport pockets 20, 27 in FIGS. 3 and 4 each have a circular design. The shape of the transport pockets can vary depending on the shape of the blanks 16. In the exemplary embodiment according to FIGS. 5 and 6, the transport pockets 20, 27 have a polygonal design and are embodied in accordance with the example as regular hexagons.

A first clearance S1 is provided between an inner contour 50 of the first transport pocket 20 and an outer contour 51 of the blank 16 or of the blank ring 46. Equally, a second clearance S2 is provided between an inner contour 52 of the second transport pocket 27 and the outer contour 51 of the blank 16 or of the blank ring 46 prior to the minting operation. The second clearance S2 is larger than the first clearance S1. In the embodiment according to FIGS. 3 and 4 the respective clearances S1, S2 are given from the difference between the first inner diameter ID1 of the first transport pocket 20 and, respectively, from the second inner diameter ID2 of the second transport pocket 27 and the blank diameter RD (prior to the minting operation). The blank ring 46 or the blank 16 can move within the first transport pocket 20 in two dimensions by the first clearance S1. These two dimensions of the relative movement are oriented at right angles to a blank axis A, about which an edge surface 53 of the blank disc 42 of the blank ring 46 runs (FIGS. 7 to 14).

Accordingly, the second clearance S2 is given from the difference between the inner diameter ID2 of the second transport pocket 27 (FIG. 4) and the blank diameter RD. Here as well, the blank 16 can move in two dimensions at right angles to the blank axis A in accordance with the second clearance S2 relative to the second transport part 26 or the second revolving plate 28. In the case of the polygonal transport pockets 20, 27 and the polygonal outer contour 51 (FIGS. 5 and 6), the first clearance S1 and the second clearance S2 are given accordingly. In contrast to the exemplary embodiment according to FIGS. 3 and 4, however, reference cannot be made to a blank diameter and an inner diameter, and instead the blank 16 or the blank ring 46 has a blank dimension RA between two opposite sides and the first transport pocket 20 has a first inner dimension IA1 between two opposite sides. Similarly hereto, the second transport pocket 27 has a second inner dimension IA2.

Further blank shapes are also possible by the transport of the blanks according to the invention. For example, the contour of the hole 45 can deviate from the outer contour 51. For example, a polygonal hole 45 can have more or fewer corners than a polygonal outer contour 51. Furthermore, it is possible to form the outer contour 51 without corners, in particular in a round manner, and to design the hole 45 in a polygonal manner, or vice versa. The radial orientation of the corners of a hole 45 can also deviate from the orientation of the corners of the outer contour 51, so that the two polygonal contours—even if the same number of corners is provided—are rotated relative to one another so to speak.

As can be seen in FIGS. 3 to 6, the first clearance S1 is smaller than the second clearance S2. The second clearance S2 is preferably at least 10% or at least 15% larger than the first clearance S1.

As a result of the larger second clearance S2, it is ensured that the minted coins, of which the diameter or dimension increases compared to the blank 16 as a result of the minting, can be received again in a second transport pocket 27 after the minting operation, so as to be further transported from the minting station 17 to the removal location 40. By contrast, the first clearance S1 is much smaller. The positioning of the blank 16 or of the blank ring 46 or the blank disc 42 in a first transport pocket 20 is thus predefined in a more exact manner. This simplifies the preparation of the blank 16 prior to the transfer to the second transport part 26 or second revolving wheel 28.

In the exemplary embodiment the hole-forming station 44 and the joining station 47 are provided as preparation stations. The first transport part 19 or the first revolving wheel 21 is used to transport the blank discs 42 to and from the hole-forming station 44 and/or to transport the blank rings 46 to the joining station 47 and/or to transport the blanks formed of a blank ring 46 and an inserted core 43 from the joining station 47 to the transfer location 34. Due to the small first clearance S1, the hole 45 can be formed more easily and the core 43 can be joined in the ring 46 more easily, since the positioning within the first transport pockets 20 is already very precise.

Figure 15:
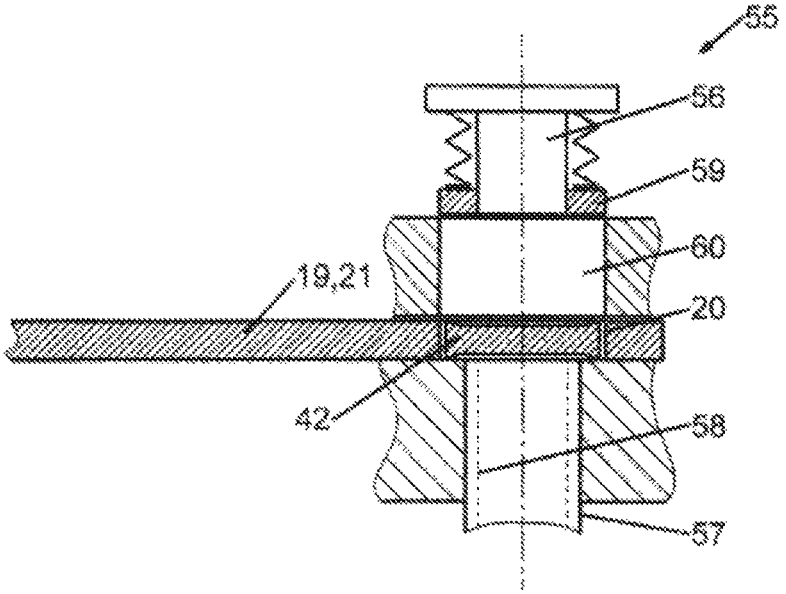
FIG. 15 shows an exemplary embodiment of a hole-forming device at a hole-forming station in a sectional, block diagram-like schematic depiction.

FIG. 15 shows, in an exemplary and heavily schematic manner, a possibility for providing a blank disc 42 with a hole 45. For example, a punch 56 can be arranged above the hole-forming station 44, in line with a first transport pocket 20. A ram 57 can be arranged beneath the transport pocket, in line with the punch 56, which ram raises the blank disc 42 from the first transport pocket 20 and presses it against the punch 56. In so doing, a hole is punched in the blank disc 42. The ram 57 has a recess 58, in which the punch 56 engages during the punching operation. The punched-out part can also be removed through this recess 58. A spring-loaded counter retaining ring 59 can be provided around the punch 56, which ring is moved against the spring force by the ram 57 during the punching and presses the blank disc 42 or the blank ring 46 against the ram 57. As appropriate, the counter retaining ring 59 can also be used to move the blank ring 46 back again into the first transport pocket 20.

As illustrated schematically in FIG. 15, an orientation channel 60 can be provided between the first transport pocket 20 and the punch 56. The blank disc 42 can be brought into a desired rotary position in the orientation channel 60 prior to the punching. This is expedient in particular when the blank disc 42 has an outer contour that is not round. To this end, the cross-sectional shape of the orientation channel 60 for example can change starting from the end associated with the first transport pocket 20 to the end associated with the punch 56 and can define the rotary position of the blank disc 42. Here, it can be expedient if the ram 57, during its stroke towards the punch 56, at the same time performs a rotary movement about its own axis, whereby the blank disc 42, as it is raised, can also be set in rotation about its blank axis A, so that the rotary orientation within the orientation channel 60 is simplified or improved by stops or other guide or orientation means provided there.

Figure 16:
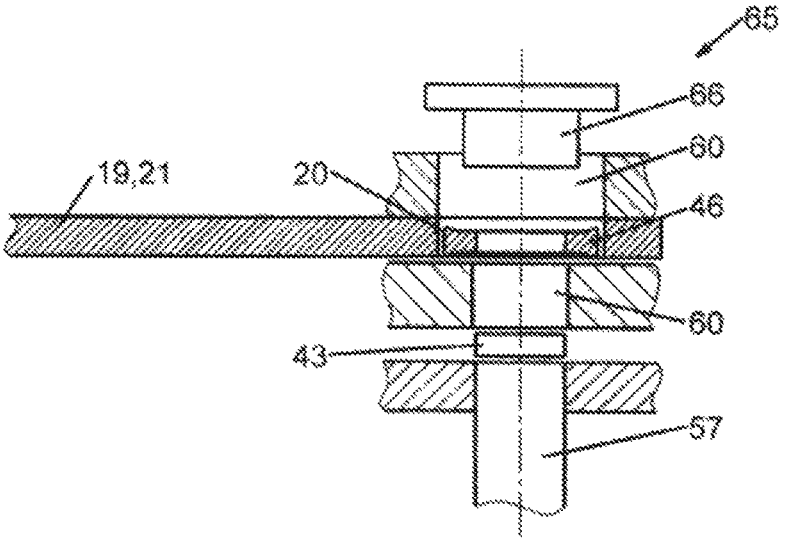
FIG. 16 shows an exemplary embodiment of a joining device at a joining station in a sectional, block diagram-like schematic depiction.

FIG. 16 shows a joining device 65, which can be used in a joining station 47. A counter holder 66 is arranged in alignment above the first transport pocket 20 in the joining station 47. Similarly to the punching device 55 according to FIG. 15, an orientation channel 60 can be provided between the counter holder 66 and the first transport pocket 20. The core 43 is fed beneath the first transport axis 20 and is positioned above a ram 57, which can raise the core 57 and move it from beneath against the blank ring 46 disposed in the first transport pocket 20. As soon as the blank ring 46 bears against the counter holder 66, the core 43 is pressed in. A further orientation channel 60 for the core 43 can be provided optionally between the feed of the core 43 and the first transport pocket 20, so that said core is oriented in a desired rotary position when it comes into contact with the blank ring 46. As is the case with the punching device 55 from FIG. 15, the ram 57 during its stroke can perform a rotary movement about its longitudinal axis at the same time so as to set the core 43 or the ring 46 in rotation, until the desired rotary position is reached. This can be advantageous in conjunction with the orientation channels 60.

The punching device 55 and the joining device 65 according to FIGS. 15 and 16 are merely exemplary. Other devices could also be used in the stations 44 and/or 47 associated with the first transport part 19 or the first revolving wheel 21. Here, it is advantageous that the position of the blank disc 42 or of the blank ring 46 in the first transport pocket 20 can be defined in a very precise manner on account of the small first clearance 51, such that the preparation of the blank 16 prior to the minting or prior to the transfer to the second transport part 26 or the second revolving wheel 28 is possible in a very simple manner.

Specifically, the presented exemplary embodiment of the transport device 15 in the case of the production or minting of a coin operates as follows:

Blank discs 42 are fed at the first feed location 41*a*. Each blank disc 42 is inserted into a first transport pocket 20 of the first revolving wheel 21. The first revolving wheel 21 is rotated intermittently in step-by-step movements about the first axis of rotation D1. The hole 45 is formed in the blank disc 42 in a hole-forming station 44, so that a ring 46 is created. This ring 46 is placed back into the same first transport pocket 20 and is transported further from the hole-forming station 44 into the joining station 47. The cores 43 are fed in the joining station 47 at the second feed location 41*b* and are inserted by means of a joining device 65 into the rings 46 disposed in the first transport pockets 20. The two-part, joined blank 16 is placed back into the first transport pocket 20 and is transported further from the joining station 47 to the transfer location 34.

At the transfer location 34 the blank 16 is transferred from a first transport pocket 20 to a second transport pocket 27 of the second revolving wheel 28. In this second transport pocket 27 the blank 16 is moved into the minting station 17 and is minted there to form a coin. On account of the large second clearance S2, sufficient space is provided to place the minted coin, which is larger than the blank 16 in terms of its outer dimensions, back into the second transport pocket 27 and to transport it from the minting station 17. The minted coins are removed at a removal location 40.

In contrast to the shown exemplary embodiments, blanks 16 or blank discs 42 or blank rings 46 having any other outer contour could also be used. It is also possible, instead of a circular or polygonal core 43, to provide any other core periphery contours, for example cores 43 with an undulating edge or with a concave and/or convex edge in part. When deciding on the contours there is great freedom for the coin designer.

The invention relates to a transport device 15 and a method for producing a coin with use of the transport device 15. The transport device 15 is used to transport blanks 16 to a minting station 17. To this end, a drivable first transport part 19 having a plurality of first transport pockets 20 is provided. A first clearance S1 exists between the outer contour 51 of the blank 16 and the inner contour 50 of the first transport pocket 20. The transport device 15 additionally has a second transport part 26 having a plurality of second transport pockets 27. A second clearance S2 is provided between the outer contour 51 of the blank 16 and the inner contour 52 of the second transport pocket 27. The second clearance S2 is larger than the first clearance S1. The blanks 16 are transferred at a transfer location 34 from a particular first transport pocket 20 into a second transport pocket 27. In the second transport pocket 27 the blanks 16 are transported to the minting station 17 and a coin is minted there from the blank 16. The minted coin is then transported further from the minting station 17 in the first transport pocket 27 of the first transport part 26 and is removed from the first transport part 26 at a removal location 40.

LIST OF REFERENCE SIGNS

15 transport device
16 blank
17 minting station
18 minting press
19 first transport part
20 first transport pocket
21 first revolving plate
22 first drive
26 second transport part
27 second transport pocket
28 second revolving plate
29 second drive
34 transfer location
35 support surface
36 support part
40 removal location
41 feed location
42 blank disc
43 core
44 hole-forming station
45 hole
46 ring
47 joining station
50 inner contour of the first transport pocket
51 outer contour of the blank
52 inner contour of the second transport pocket
53 edge surface
55 punching device
56 punch
57 ram
58 recess
59 counter retaining ring
60 orientation channel
65 joining device
66 counter holder
A blank axis
D1 first axis of rotation
D2 second axis of rotation
IA1 first inner dimension
IA2 second inner dimension
ID1 first inner diameter
ID2 second inner diameter
RA blank dimension
RD blank diameter

What is claimed is:

1. A transport device configured to transport a plurality of blanks (16), the transport device system comprising:

the plurality of blanks (16), wherein each of the blanks (16) a multi-part blank (16) comprising a plurality of constituents, each of the multi-part blanks to be minted into a multi-part coin, a transport device (15) comprising:

a drivable first transport part (19), including a plurality of first transport packets (20) each configured to receive a single multi-part blank of the plurality of multi-part blanks (16) and each of the first transport packets (20) configured to provide a first clearance (S1) between an outer contour (51) of the received single multi-part blank (16) and an inner contour (50) of the first transport pocket (20), a drivable second transport part (26), including a plurality of second transport pockets (27) each configured to receive the received single multi-part blank (16) of the first transport pocket (20), and configured to provide a second clearance (S2) between the outer contour (51) of the received single multi-part blank (16) and an inner contour (52) of the second transport pocket (27), wherein the first clearance (S1) is smaller than the second clearance (S2), the transport device (15) having a transfer location (34), at which the received single multi-part blank (16) is transferred from the drivable first transport part (19) to the drivable second transport part (26), the drivable second transport part (26) further including a minting station (17) configured to mint the multi-part coin from the received single multi-part blank (16), the drivable second transport part (26) configured to transport the received single multi-part blank (16) from the transfer location (34) to the minting station (17) to be minted and the drivable second transport part (26) configured to transport the minted multi-part coin from the minting station (17) to a removal location (40).

2. The transport device system according to claim 1, characterised in that the plurality of constituents of each of the multi-part blanks (16) comprises an inner constituent (43) and an outer constituent (46).

3. The transport device according to claim 2, characterised in that at least one preparation station (44, 47) is arranged adjacently to the first transport part (19) and is configured to prepare each of the received single multi-part blanks (16) for a subsequent minting operation at the minting station (17).

4. The transport device system according to claim 3, characterised in that the at least one preparation station includes a joining station (47), at which at least the inner constituent (43) and the outer constituent (46) of the plurality of constituents are joined together to form each of the received single multi-part blank (16).

5. The transport device according to claim 3, characterised in that the outer constituent (46) of each of the received single multi-part blank (16) is formed from a pre-constituent blank disc (42), the at least one preparation station includes a hole-forming station (44) and/or a forming station, at which a hole (45) is formed in the pre-constituent blank disc (42) to form the outer constituent (46) comprising a ring.

6. The transport device system according to claim 1, characterised in that a control device (30) is provided, which is configured to control a first drive (22) for the drivable first transport part (19) and a second drive (29) for the drivable second transport part (26).

7. The transport device system according to claim 1, characterised in that the drivable first transport part (19) is a first revolving plate (21) and/or the drivable second transport part (26) is a second revolving plate (28).

8. The transport device system according to claim 7, characterised in that the first revolving plate (21) has a larger diameter than the second revolving plate (28).

9. The transport device system according to claim 1, characterised in that the number of first transport pockets (20) at the drivable first transport part (19) is greater than the number of the second transport pockets (27) at the drivable second transport part (26).

10. A method for producing the minted multi-part coin with use of the transport device system according to claim 1, said method comprising the following steps:

transporting the received single multi-part blank (16) in one of the plurality of first transport pockets (20) of the drivable first transport part (19) to the transfer location (34), while providing the first clearance (S1) between the outer contour (51) of the received single multi-part blank (16) and the inner contour (50) of the one first transport pocket (20), transferring the received single multi-part blank (16) into one of the plurality of second transport pockets (27) of the drivable second transport part (26) at the transfer location (34), while providing the second clearance (S2) between the outer contour (51) of the received single multi-part blank (16) and the inner contour (52) of the one second transport pocket (27), wherein the first clearance (S1) is smaller than the second clearance (S2), transporting the received single multi-part blank (16) in the one second transport pocket (27) of the drivable second tranpsort part (26) to the minting station (17), minting the multi-part coin from the received single multi-part blank (16) in the minting station (17), transporting the multi-part coin from the minting station (17) in one of the second transport pockets (27) of the second transport part (26) to the removal location (40).

11. The method according to claim 10, which additionally comprises the following steps:

transporting an outer constituent (46) comprising a ring of the plurality of constituents of the received single multi-part blank (16) in one of the plurality of the first transport pockets (20) of the drivable first transport part (19) to a joining station (47) arranged adjacently to the drivable first transport part (19), inserting an inner constituent (43) comprising a core of the plurality of constituents of the received single multi-part blank (16) into the outer constituent (46) at the joining station (47), transporting the received single multi-part blank (16) from the joining station (47) in one of the plurality of first transport pockets (20) of the drivable first transport part (19) to the transfer location (34).

12. The method according to claim 11, wherein a pre-constituent of the received single multi-part blank (16) of the transport device system comprises a blank disc (42), said method additionally comprises the following steps:

transporting the pre-constituent blank disc (42) of the received single multi-part blank (16) in one of the plurality of first transport pockets (20) of the drivable first transport part (19) to a hole-forming station (44) arranged adjacently to the drivable first transport part (19), forming a hole (45) in the pre-constituent blank disc (42) in the hole-forming station (44) to produce the outer constituent (46) comprising the ring of the received single multi-part blank (16)

transporting the outer constituent (46) comprising the ring of the received single multi-part blank (16) in one of the plurality of first transport pockets (20) of the first tranpsort part (19) from the hole-forming station (44).

13. The method according to claim 12, which additionally comprises the following step:

forming an inner edge of the outer constituent (46) comprising the ring of the received single multi-part blank (16) in the hole-forming station (44) or a forming station.

* * * * *